US005229558A

United States Patent [19]

Hakala

[11] Patent Number: 5,229,558

[45] Date of Patent: Jul. 20, 1993

[54] CONTROL OF AN ELEVATOR HOISTING MOTOR DURING UNDER VOLTAGE CONDITIONS IN THE MAIN POWER SOURCE

[75] Inventor: Harri Hakala, Hyvinkaa, Finland

[73] Assignee: Kone Elevator GmbH, Baar, Switzerland

[21] Appl. No.: 607,188

[22] Filed: Oct. 31, 1990

[30] Foreign Application Priority Data

Oct. 31, 1989 [FI] Finland ..... 895170

[51] Int. Cl.[5] ..... B66B 5/02

[52] U.S. Cl. ..... 187/118; 187/119; 187/120

[58] Field of Search ..... 187/118, 120, 119, 114; 318/762; 361/92

[56] References Cited

U.S. PATENT DOCUMENTS

| | | | |
|---|---|---|---|
| 3,552,524 | 1/1971 | Benjamin et al. | 187/118 |
| 3,584,706 | 6/1971 | Hall | 187/5 |
| 3,688,874 | 9/1972 | Lusti et al. | 187/120 |
| 3,891,064 | 6/1975 | Clark | 187/118 |
| 3,940,664 | 2/1976 | Matsko | 361/92 |
| 3,961,688 | 6/1976 | Maynard | 187/105 |
| 4,382,221 | 5/1983 | Reynolds | 320/35 |
| 4,503,938 | 3/1985 | Nomura | 187/119 |
| 4,506,766 | 3/1985 | Watanabe | 187/114 |
| 4,640,389 | 2/1987 | Kamalke | 187/119 |
| 4,890,005 | 12/1989 | Schornack | 361/92 |
| 4,902,954 | 2/1990 | Oshima et al. | 318/762 |

FOREIGN PATENT DOCUMENTS

| | | |
|---|---|---|
| 8801450 | 2/1988 | Int'l Pat. Institute . |
| 2168829A | 6/1986 | United Kingdom . |
| 2169160A | 7/1986 | United Kingdom . |

*Primary Examiner*—Jeffrey A. Gaffin

*Attorney, Agent, or Firm*—Sughrue Mion Zinn Macpeak & Seas

[57] ABSTRACT

A method and an apparatus for the control of an elevator a.c. or d.c. hoisting motor driven by a frequency converter unit, or by a rectifier unit, supplied by a three phase power source is disclosed. The voltage of the mains power source is monitored using a voltage measuring unit. The frequency converter or rectifier is supervised by a control unit which selects a speed reference curve, best suited for a run. The controller unit allows the elevator speed to be varied continuously with the mains voltage so that the elevator always travels at the highest possible speed. When an undervoltage condition is detected in the mains power source, the rotational speed of the hoisting motor is reduced without modifying the acceleration so as to avoid an overcurrent if the rectifier or inverter switches. If, in addition, the acceleration is decreased before the maximum speed is obtained, a higher maximum speed may be obtained for a given low level of supply voltage. The solution offered by this invention enables the elevator system to work at undervoltages as low as 60%.

10 Claims, 5 Drawing Sheets

FIG. 1 PRIOR ART (CURVES A, B, C)

CONTROL OF AN ELEVATOR HOISTING MOTOR DURING UNDER VOLTAGE CONDITIONS IN THE MAIN POWER SOURCE

BACKGROUND OF THE INVENTION

Field of the Invention

The present invention relates to a procedure and an apparatus for the control of the speed and acceleration of a hoisting motor, driven by a frequency converter (when an a.c. motor used as a hoisting motor) or by a rectifier (when a d.c. motor is used), said frequency converter or rectifier being connected to mains power source and controlled by a control unit.

Many problems are encountered in driving the hoisting motor of an elevator when an undervoltage condition appears in the mains power source. Since the torque of the motor is proportional to the square of the supply voltage, the motor cannot produce a full torque in undervoltage conditions at full speed. In this situation, the motor is unable to accelerate the elevator according to the speed reference, leading to the saturation of the controllers and, in the worst case, to an interruption in the operation of the elevator. If the motor has to produce a full torque in undervoltage conditions, the current will increase correspondingly. This may lead to overcurrent tripping.

No solution to this problem has generally been provided, but interruptions in elevator operation are common in cases where the power supply is too low, or subject to frequent and large voltage variations. A possible solution is to use an overrated motor having high enough parameters to ensure that the motor is able to produce a sufficient torque even in undervoltage conditions.

A drawback with an overrated motor is its high price, which is why this solution is not generally used. Therefore, a voltage reduction of only 5% is considered in the motor selection.

SUMMARY OF THE INVENTION

An object of the present invention is to eliminate the drawbacks referred to. The procedure of the invention for controlling a hoisting motor in undervoltage conditions is characterized in that the voltage of the power supply is determined using a voltage measuring unit, and when an undervoltage condition is detected in the power supply, the rotational speed and/or acceleration of the hoisting motor are/is reduced.

Another object of the present invention is to provide a driving system for an elevator, wherein regardless of the reduced maximum speed, the elevator will be able to operate without interruptions and with normal acceleration. The acceleration can also be reduced, in which case a higher maximum speed is achieved with the same voltage. The controllers of the rectifier and converter also work normally, and the currents in the motor windings remain at the acceptable working levels.

The costs resulting from applying the invention are considerably lower than those resulting from the use of an overrated motor. The effect of the reduced maximum speed on the elevator capacity is not important, especially considering that otherwise the operation of the elevator would be interrupted.

Accordingly, in a procedure for the control of a hoisting motor according to the invention, an a.c. motor used as a hoisting motor is fed via a frequency converter connected to the three phase power source or a d.c. motor is fed via a rectifier connected to the three phase power source, said frequency converter or rectifier being controlled by a control unit wherein the voltage of the mains power supply is determined using a voltage measuring unit and when an undervoltage condition is detected in the mains power supply, the rotational speed and/or acceleration of the hoisting motor are/is reduced.

BRIEF DESCRIPTION OF THE DRAWINGS

In the following, the invention is described in detail by the aid of examples, reference being made to the appended drawings, in which.

DETAILED DESCRIPTION OF THE INVENTION

Figure 1:
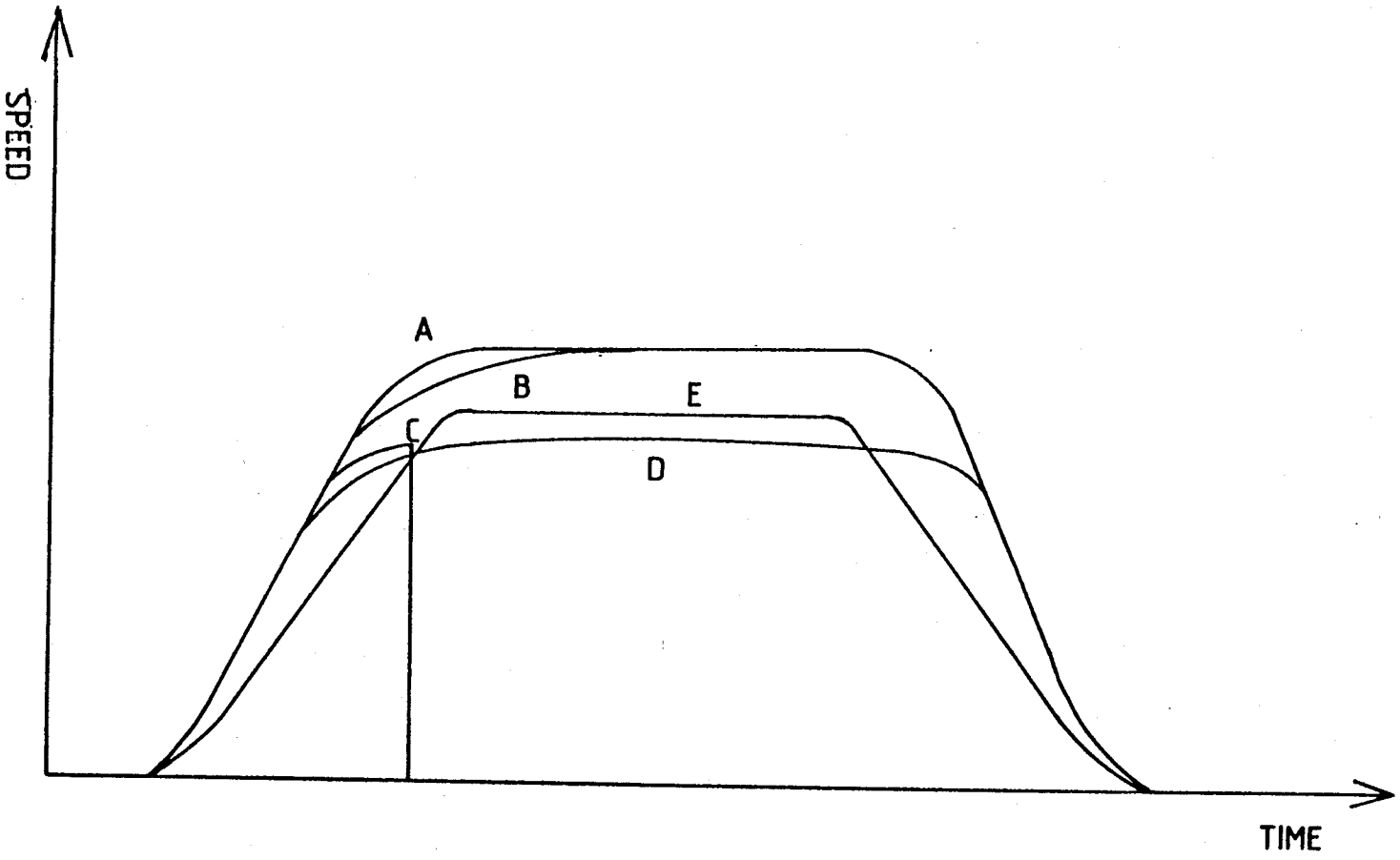
FIG. 1 comparatively illustrates the speed curves of the hoisting motor of an elevator according to both the prior art and the invention.

A specific feature of frequency converter control is that the voltage required by the motor is approximately proportional to the speed of the elevator. When the elevator is operated in conditions where the mains voltage is normal or max. 5% below normal, the elevator speed follows curve A in FIG. 1. If the decrease of the mains voltage is not very large, the torque is diminished during acceleration and the nominal speed is reached more slowly (curve B). However, if the voltage decrease is too large, the elevator will stop (curve C) when a conventional driving system is used.

However, the operation of the elevator will continue if a maximum speed below the nominal maximum speed value is selected, in other words, if acceleration is reduced to zero before the torque falls too much (curve D). If the acceleration is additionally decreased before the maximum speed is reached, a higher maximum speed can be obtained (curve E).

Figure 2:
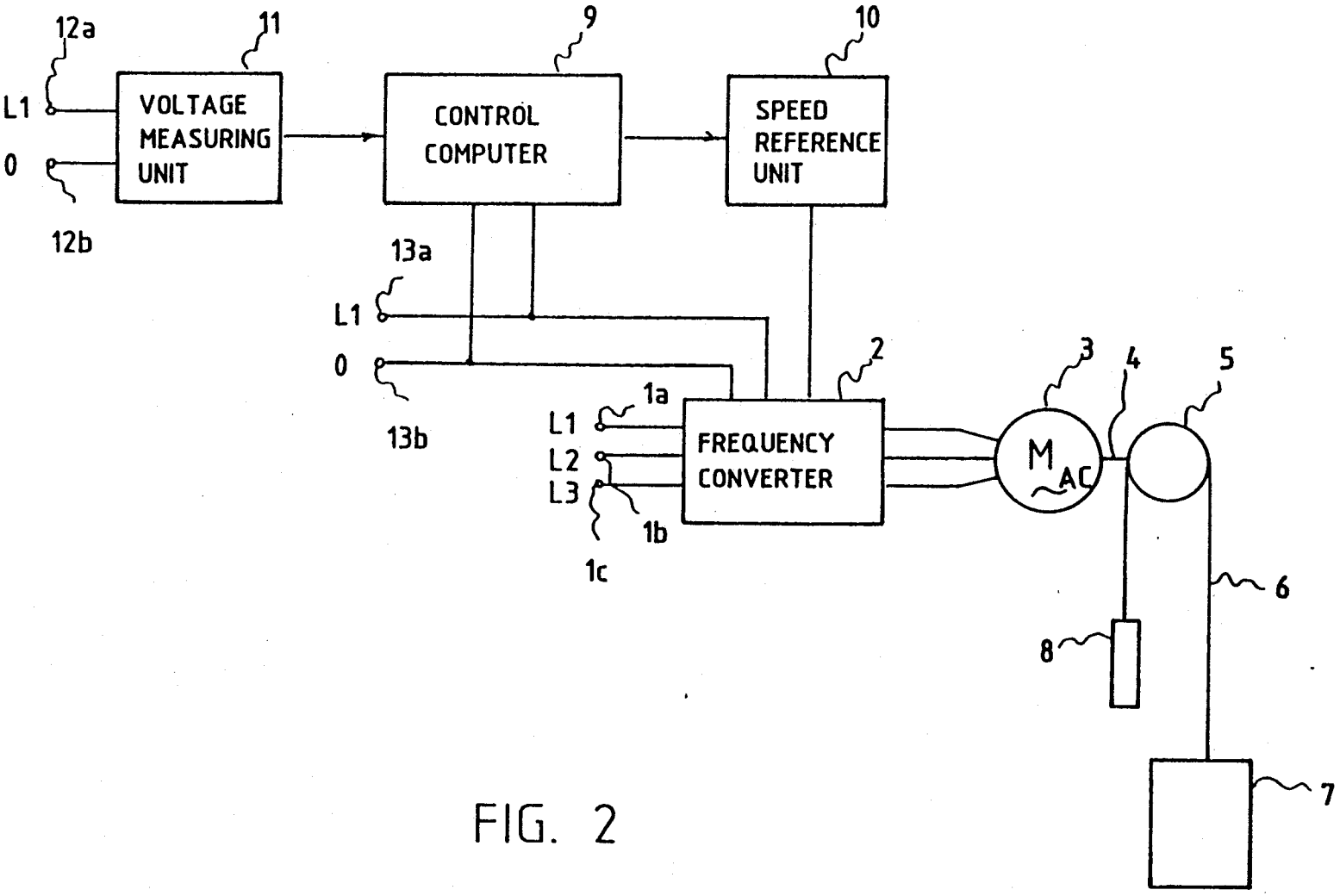
FIG. 2 is a block diagram of the driving system for an elevator a.c. motor as provided by the present invention.

FIG. 2 illustrates a frequency converter drive for an a.c. motor of an elevator, comprising a frequency converter 2 connected via terminals 1*a*–1*c* to a three-phase mains network L1–L3. The frequency converter feeds a three-phase squirrel-cage motor ($M_{AC}$) 3 which drives via shaft 4 a traction sheave 5 transmitting the motion via hoisting ropes 6 to an elevator car 7 and its counterweight 8. The frequency converter is controlled by means of a control computer 9 and a speed reference unit 10.

To cope with undervoltage situations, the elevator control system is provided with a voltage measuring unit 11 (e.g. a relay or other device) for measuring the mains voltage, said unit being connected to the three phase power source via terminals 12*a* and 12*b*. The output signal generated by voltage measuring unit 11 may be analog or digital and it acknowledges the control computer of the existence of an undervoltage condition on the line.

Control computer 9 drives the speed reference unit 10 to select an appropriate speed reference curve according to the value of the line voltage and other traffic parameters. It monitors the speed of the motor so that a unique speed reference curve is used during a run, preventing swinging of the speed. The correct speed reference curve for a particular run is selected using parameters as the travel, nominal speed, nominal acceleration and the maximum speed of change of the acceleration (yerk).

Figure 3:
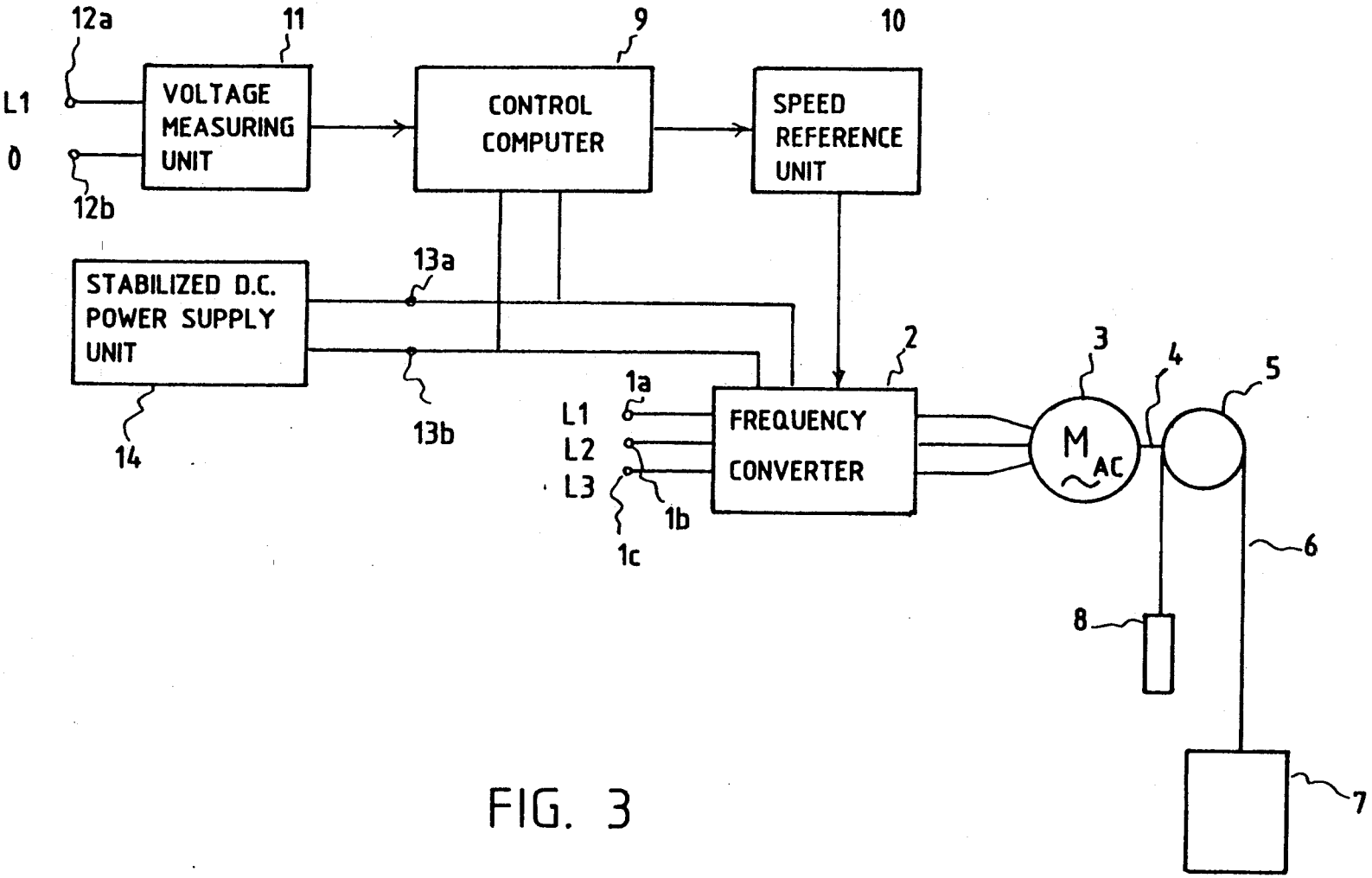
FIG. 3 is a block diagram of the driving system for an elevator a.c. motor as provided by another embodiment of the present invention.

The elevator speed can be varied continuously with the mains voltage, so that the elevator always travels at the highest possible speed. Another alternative is to reduce the elevator speed to a preselected level corresponding to a given voltage reduction. If necessary, several levels can be used. For obtaining a correct response in the case of large drops of line voltage, an auxiliary stabilized power supply unit is provided in the present invention for supplying the electronic circuits of the controller. The auxiliary voltage for the driving system can be taken directly from the mains (terminals 13*a* and 13*b*), in which case the control of the motor will be effective for undervoltages in the range of −10 . . . −15%, ensuring e.g. the operation of the contactors. This is a simple solution. It is also possible to provide additional stabilization for the auxiliary voltage, e.g. by using a stabilized d.c. power supply unit 14 (e.g. batteries) as illustrated by FIG. 3. This solution enables the system to work at undervoltages as low as −60%.

Figure 4:
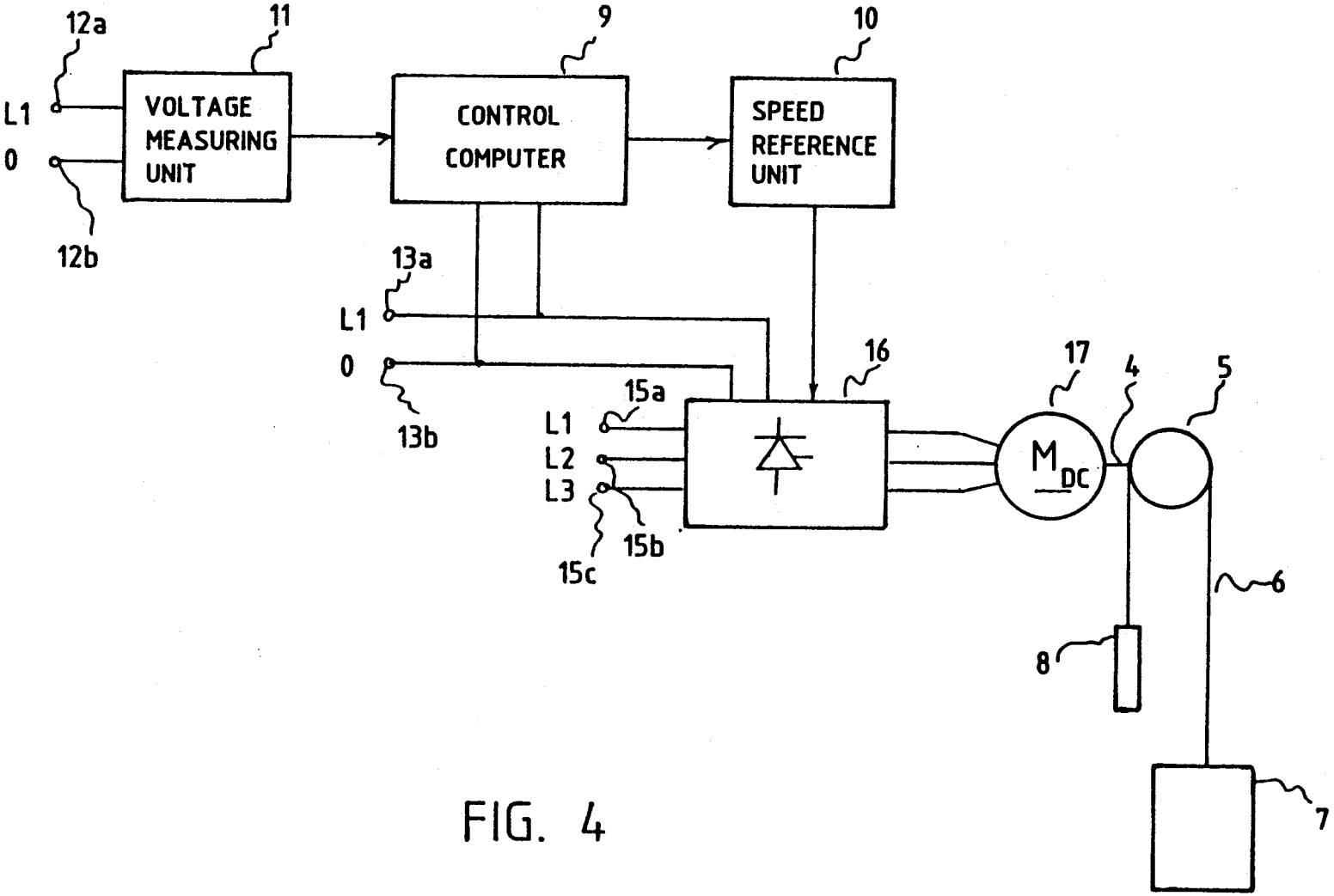
FIG. 4 is a block diagram of the driving system for an elevator d.c. motor as provided by the present invention.
Figure 5:
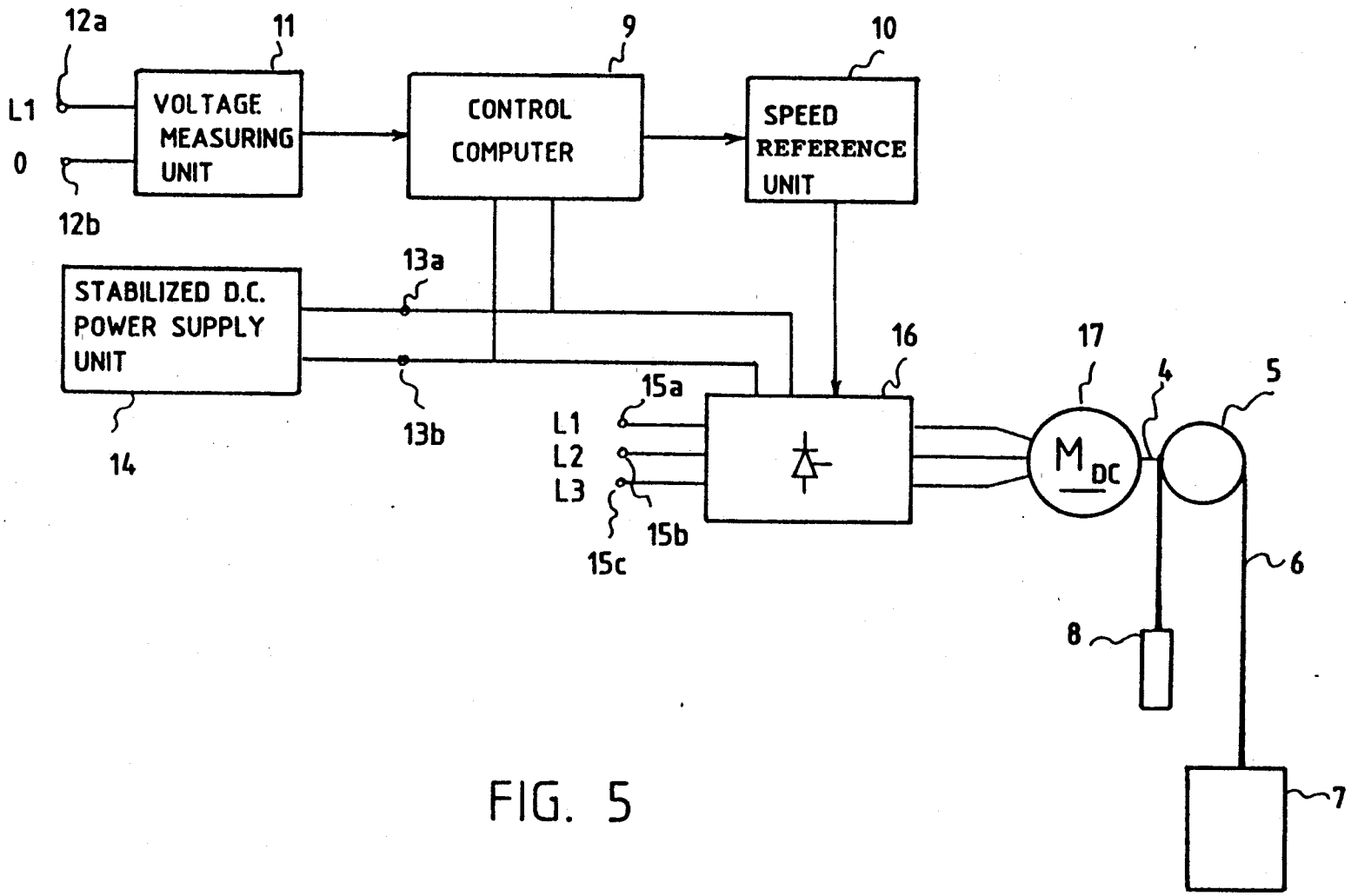
FIG. 5 is a block diagram for the driving system for an elevator d.c. motor as provided by another embodiment of the present invention.

The invention can also be applied to d.c. motors as illustrated in FIGS. 4 and 5, in which a rectifier 16 connected to the mains via terminals 15*a*–15*c* feeds a d.c. motor ($M_{DC}$) 17 used to drive an elevator as explained above.

It is obvious to a person skilled in the art that different embodiments of the invention are not restricted to the examples described above, but that they may instead be varied within the scope of the following claims.

We claim:

1. A method for the control of an elevator hoisting motor, in which an a.c. motor used as a hoisting motor is connected via a frequency converter to a three phase mains power source or a d.c. motor is connected via a rectifier to a three phase mains power source, said frequency converter or rectifier being controlled by a control unit, said method comprising the steps of:

(a) monitoring the voltage of the mains power source using a voltage measuring unit;

(b) detecting an undervoltage condition in the mains power source and, depending on the severity of the undervoltage:

(b1) reducing the maximum rotational speed of the hoisting motor to a lower lever;

(b2) reducing the acceleration of the hoisting motor, before said maximum speed is attained; or (b3) reducing the maximum rotational speed and acceleration of the hoisting motor.

2. A procedure as claimed in claim 1, wherein an auxiliary d.c. voltage for the driving system is obtained from the mains power source.

3. A procedure as claimed in claim 1, wherein an auxiliary d.c. voltage for the driving system is obtained by means of a stabilized d.c. power supply unit.

4. An apparatus for the control of an elevator a.c. hoisting motor implementing the procedure of claim 1, comprising a frequency converter connected to a three phase mains power source for driving said a.c. hoisting motor; a control unit for controlling the frequency converter and a voltage measuring unit connected to the control unit for detecting the voltage of the mains power source so that, when an undervoltage condition is detected the control unit reduces the rotational speed and/or acceleration of the hoisting motor.

5. An apparatus for the control of an elevator d.c. hoisting motor implementing the procedure of claim 1, comprising a rectifier connected to a three phase mains power source for driving said d.c. hoisting motor; a control unit for controlling the rectifier and a voltage measuring unit connected to the control unit for detecting the voltage of the mains power source so that, when an undervoltage condition is detected the control unit reduces the rotational speed and/or acceleration of the hoisting motor.

6. An apparatus as claimed in claim 4 or 5, wherein the voltage measuring unit is a voltage relay.

7. An apparatus as claimed in claims 4 or 5, further comprising a stabilized d.c. power supply unit for the stabilization of the auxiliary voltage of the driving system.

8. An apparatus as claimed in claim 7, wherein stabilized d.c. power supply unit comprises means for continuous supply of electricity.

9. A method for the control of an elevator hoisting a.c. motor supplied from a three phase mains power source via a frequency converter or of a d.c. motor supplied via a rectifier, comprising the steps of:

(a) monitoring the voltage of a mains power source using a voltage measuring means; and informing said control unit on the status of the power source voltage;

(b) determining and selecting an optimum speed for a particular measurement and varying the hoisting motor speed continuously in accordance with the voltage of the power source so as to obtain a maximum rotational speed level of the hoisting motor;

(c) reducing said maximum rotational speed level of the hoisting motor in response to the detection of an undervoltage condition in the power source; and (d) reducing the acceleration of the hoisting motor in response to the detection of said undervoltage condition, so that a higher maximum speed level is obtained in step (c).

10. An apparatus for the control of an elevator a.c. hoisting motor having a frequency converter unit or an elevator d.c. hoisting motor having a rectifier unit connected to a three phase mains power source for driving said hoisting motor, comprising:

a voltage measuring unit, detecting the voltage of the power source;

a speed reference unit, storing simulated speed curves for controlling the frequency converter or the rectifier; and a control unit receiving the output of said voltage measuring unit, driving said speed reference unit to select a speed reference curve to control the frequency converter or the rectifier, so that, when an undervoltage condition is detected, the rotational speed and/or acceleration of the hoisting motor of the elevator are/is reduced.

* * * * *